United States Patent [19]

Arakawa et al.

[11] Patent Number: 4,713,549

[45] Date of Patent: Dec. 15, 1987

[54] RADIATION IMAGE STORAGE PANEL

[75] Inventors: Satoshi Arakawa; Masamitu Nonomura, both of Kanagawa, Japan

[73] Assignee: Fuji Photo Film Co., Ltd., Japan

[21] Appl. No.: 847,709

[22] Filed: Apr. 3, 1986

[30] Foreign Application Priority Data

Apr. 3, 1985 [JP] Japan ..... 60-70239

[51] Int. Cl.[4] ..... G03C 5/16

[52] U.S. Cl. ..... 250/484.1

[58] Field of Search ..... 250/327.2, 484.1

[56] References Cited

U.S. PATENT DOCUMENTS 4,350,893 9/1982 Takahashi et al. ..... 250/337

4,497,865 2/1985 Minami et al. ..... 360/135

*Primary Examiner*—Carolyn E. Fields

*Attorney, Agent, or Firm*—Gerald J. Ferguson, Jr.; Michael P. Hoffman; Michael J. Foycik, Jr.

[57] ABSTRACT

A radiation image storage panel comprising a support, a phosphor layer which comprises a binder and a stimulable phosphor dispersed therein and a protective film, superposed in this order, characterized in that said protective film comprises polyethylene terephthalate, and has the longitudinal strength and the lateral strength equal to each other or in a difference therebetween of not more than 10%, the value being determined based on the larger strength.

3 Claims, 1 Drawing Figure

RADIATION IMAGE STORAGE PANEL

BACKGROUND OF THE INVENTION

1. Field of the Invention

This invention relates to a radiation image storage panel comprising a support, a phosphor layer which contains a stimulable phosphor and a protective film, superposed in this order.

2. Description of Prior Arts

For obtaining a radiation image, there has been conventionally employed a radiography utilizing a combination of a radiographic film having an emulsion layer containing a photosensitive silver salt and a radiographic intensifying screen.

As a method replacing the conventional radiography, a radiation image recording and reproducing method utilizing a stimulable phosphor as described, for instance, in U.S. Pat. No. 4,239,968, has been recently paid much attention. In the radiation image recording and reproducing method, a radiation image storage panel comprising a stimulable phosphor (i.e., stimulable phosphor sheet) is used, and the method involves steps of causing the stimulable phosphor of the panel to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (stimulated emission); photoelectrically detecting the emitted light to obtain electric signals; and reproducing the radiation image of the object as a visible light from the electric signals.

In the radiation image recording and reproducing method, a radiation image is obtainable with a sufficient amount of information by applying a radiation to the object at considerably smaller dose, as compared with the conventional radiography. Accordingly, this method is of great value especially when the method is used for medical diagnosis.

The radiation image storage panel employed in the radiation image recording and reproducing method has a basic structure comprising a support and a phosphor layer provided on one surface of the support. Further, a transparent film is generally provided on the free surface (surface not facing the support) of the phosphor-layer to keep the phosphor layer from chemical deterioration or physical shock.

The phosphor layer comprises a binder and stimulable phosphor particles dispersed therein. The stimulable phosphor emits light (gives stimulated emission) when excited with an electromagnetic wave (stimulating rays) such as visible light or infrared rays after having been exposed to a radiation such as X-rays. Accordingly, the radiation having passed through or having radiated from an object is absorbed by the phosphor layer of the panel in proportion to the applied radiation dose, and a radiation image of the object is produced in the panel in the form of a radiation energy-stored image. The radiation energy-stored image can be released as stimulated emission by sequentially irradiating (scanning) the panel with stimulating rays. The stimulated emission is then photoelectrically detected to give electric signals, so as to reproduce a visible image from the electric signals.

When the radiation image recording and reproducing method is practically carried out, the radiation image storage panel is repeatedly used in a cyclic procedure comprising steps of exposing the panel to a radiation (i.e., recording a radiation image), irradiating the panel with stimulating rays (i.e., reading out the recorded radiation image), and exposing the panel to light for erasure (i.e., erasing the remaining energy from the panel). In the cyclic procedure, moving the panel from one step to the next step is done by a transfer system, and after one cycle is finished, the panel is usually piled upon other panels and stored.

More in detail, the radiation image storage panel is moved from one step to the next step through the transfer system which comprises rolls, transfer belts and guide plates combined in various manners in a radiation image recording and reproducing apparatus. In such transfer system, the panel is not always moved only in the longitudinal direction of the panel, and depending on the apparatus, the panel is moved in the lateral direction thereof or in both the directions. Accordingly, the protective film of the panel preferably has a large thickness from the viewpoint of mechanical strength such as bending strength, though the mechanical strength required for the protective film varies depending on the purpose of use of the panel, kind of the apparatus, etc.

On the other hand, the radiation image is read out from the transparent protective film-side surface of the radiation image storage panel by scanning the panel with stimulating rays, so that the thickness of the protective film is desired to be as small as possible from the viewpoint of image quality such as sharpness of the image. As the protective film of the panel having a small thickness and a high mechanical strength, there has been so far employed a polyethylene terephthalate film improved in the mechanical strength against bend or the like by means of stretching. However, the conventional polyethylene terephthalate film has a large difference between the strength in one direction and the strength in the direction perpendicular thereto (e.g., longitudinal direction and lateral direction), and the lateral strength has been liable to be small even when the longitudinal strength being satisfactory.

Particularly in the case that the radiation image storage panel is transferred in both of the longitudinal and lateral directions, the protective film tends to suffer damages such as cracks or wrinkles caused by bending or the like by means of rolls during the transfer in the lateral direction. Such damages give rise not only to decrease the function of the protective film per se but also to deteriorate the quality of resulting image. Accordingly, the panel is desired to be prevented from suffering damages on the protective film during the transfer.

SUMMARY OF THE INVENTION

It is an object of the present invention to provide a radiation image storage panel free from the directional property on the mechanical strength of the protective film thereof.

It is another object of the present invention to provide a radiation image storage panel improved in the durability as compared with the conventional radiation image storage panel having a protective film at the same thickness.

The objects can be accomplished by a radiation image storage panel comprising a support, a phosphor layer which comprises a binder and a stimulable phosphor dispersed therein and a protective film, superposed in this order, characterized in that said protective film comprises polyethylene terephthalate, and has the longitudinal strength and the lateral strength equal to each other or in a difference therebetween of not more than 10%, the value being determined based on the larger strength.

In the present invention, the term "longitudinal direction" of the radiation image storage panel means a direction of major axis of the panel in the form of a rectangular sheet, and the term "lateral direction" means a direction of minor axis thereof. The term "strength" means a force (F-5, kg/mm$^2$) required to stretch a thin film by 5% longer than its initial length in each direction, and the difference between the longitudinal strength and the lateral strength is expressed by a ratio to the strength larger than the other.

According to the present invention, the difference between the longitudinal strength and the lateral strength is made smaller with respect to the protective film of the radiation image storage panel, so as to prevent the protective film from suffering damages when the panel is moved in either of the longitudinal and lateral directions and to enhance the durability of the panel remarkably.

In more detail, the protective film of the conventional radiation image storage panel is strong enough to be moved in the longitudinal direction, but it hardly endures the transfer in the lateral direction because of its insufficient lateral strength. In the invention, the difference of strength between both directions is made to not more than 10% of the larger strength (i.e., strength in the longitudinal direction), so as to provide the protective film with sufficient mechanical strength not only in one direction but also in the other direction when the thickness thereof is same as the conventional one. Accordingly, whichever direction the panel is moved in, the protective film is prevented from suffering cracks, wrinkles, etc. on its surface.

Further, the radiation image storage panel of the invention employs polyethylene terephthalate which has a high transparency and a high hardness in addition to the above-mentioned high mechanical strength as a material of the protective film, whereby the surface of the protective film is hardly damaged when the panel rubs against another panel during the piling procedure in the transfer system. Therefore, the invention provides a radiation image storage panel having excellent properties such as giving an image of high quality.

DETAILED DESCRIPTION OF THE INVENTION

Figure 1:
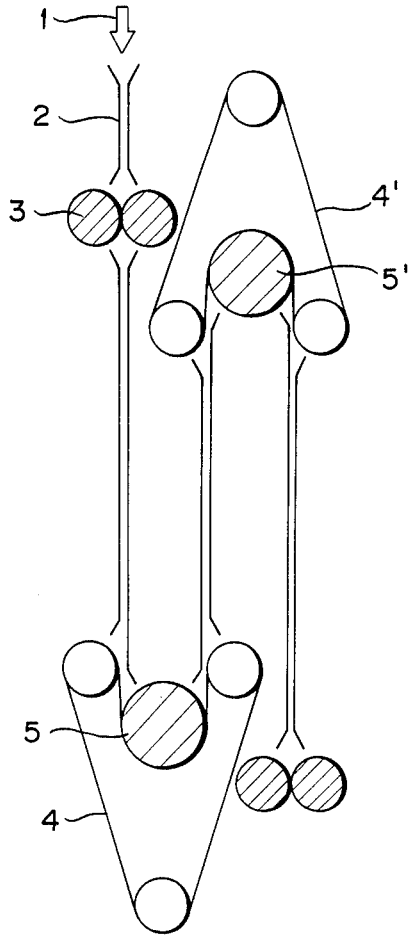
FIG. 1 is a plane view schematically illustrating a transfer testing device.

The radiation image storage panel of the present invention having the above-described advantages can be prepared, for instance, in the following manner.

The support material employed in the present invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer, so as to enhance the adhesion between the support and the phosphor layer, or to improve the sensitivity of the panel or the quality of an image (sharpness and graininess) provided thereby. For instance, a subbing layer may be provided by coating a polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support.

As described in U.S. patent application Ser. No. 496,278, the phosphor layer-side surface of the support (or the surface of a subbing layer, light-reflecting layer, or light-absorbing layer in the case that such layers are provided on the phosphor layer) may be provided with protruded and depressed portions for enhancement of the sharpness of the image.

On the support, a phosphor layer is formed. The phosphor layer basically comprises a binder and stimulable phosphor particles dispersed therein.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wavelength region of 400–900 nm.

Examples of the stimulable phosphor employable in the radiation image storage panel of the invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{II}O.xSiO_2$:A, in which $M^{II}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,236,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in U.S. Pat. No. 4,236,078;

$(Ba_{1-x},M^{2+}{}_x)FX:yA$, in which $M^{2+}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0\leqq x\leqq 0.6$ and $0\leqq y\leqq 0.2$, respectively, as described in U.S. Pat. No. 4,239,968;

$M^{II}FX.xA:yLn$, in which $M^{II}$ is at least one element selected from the group consisting of Ba, Ca, Sr, Mg, Zn and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br and I; and x and y are numbers satisfying the conditions of $5\times 10^{-5}\leqq x\leqq 0.5$ and $0<y\leqq 0.2$, respectively, as described in Japanese Patent Provisional Publication No. 55(1980)-160078;

$(Ba_{1-x},M^{II}{}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5\leqq a\leqq 1.25$, $0\leqq x\leqq 1$, $10^{-6}\leqq y\leqq 2\times 10^{-1}$, and $0<z\leqq 10^{-2}$, respectively, as described in Japanese Patent Provisional Publication No. 56(1981)-116777;

$(Ba_{1-x},M^{II}{}_x)F_2.aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5\leqq a\leqq 1.25$, $0\leqq x\leqq 1$, $10^{-6}\leqq y\leqq 2\times 10^{-1}$, and $0<z\leqq 2\times 10^{-1}$, respectively, as described in Japanese Patent Provisional Publication No. 57(1982)-23673;

$(Ba_{1-x},M^{II}{}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and z are numbers satisfying the conditions of $0.5\leqq a\leqq 1.25$, $0\leqq x\leqq 1$, $10^{-6}\leqq y\leqq 2\times 10^{-1}$, and $0<z\leqq 5\times 10^{-1}$, respectively, as described in Japanese Patent Provisional Publication No. 57(1982)-23675;

$M^{III}OX:xCe$, in which $M^{III}$ is at least one trivalent metal selected from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0<x<0.1$, as described in Japanese Patent Provisional Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yb, Lu, Al, Ga, In and Tl; X is at least one halogen selected from the group consisting of Cl, Br and I; and x and y are numbers satisfying the conditions of $10^{-2}\leqq x\leqq 0.5$ and $0<y\leqq 0.1$, respectively, as described in U.S. patent application Ser. No. 497,805;

$BaFX.xA:yEu^{2+}$, in which X is at least one halogen selected from the group consisting of Cl, Br and I; A is at least one fired product of a tetrafluoroboric acid compound; and x and y are numbers satisfying the conditions of $10^{-6}\leqq x\leqq 0.1$ and $0<y\leqq 0.1$, respectively, as described in U.S. patent application Ser. No. 520,215;

$BaFX.xA:yEu^{2+}$, in which X is at least one halogen selected from the group consisting of Cl, Br and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6}\leqq x\leqq 0.1$ and $0<y\leqq 0.1$, respectively, as described in U.S. patent application Ser. No. 502,648;

$BaFX.xNaX':aEu^{2+}$, in which each of X and X' is at least one halogen selected from the group consisting of Cl, Br and I; and x and a are numbers satisfying the conditions of $0<x\leqq 2$ and $0<a\leqq 0.2$, respectively, as described in Japanese Patent Provisional Publication No. 59(1984)-56479;

$M^{II}FX.xNaX':yEu^{2+}:zA$, in which $M^{II}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0<x\leqq 2$, $0<y\leqq 0.2$ and $0<z\leqq 10^{-2}$, respectively, as described in U.S. patent application Ser. No. 535,928;

$M^{II}FX.aM^{I}X'.bM'^{II}X''_2.cM^{III}X'''_3.xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0\leqq a\leqq 2$, $0\leqq b\leqq 10^{-2}$, $0\leqq c\leqq 10^{-2}$ and $a+b+c\geqq 10^{-6}$; and x and y are numbers satisfying the conditions of $0<x\leqq 0.5$ and $0<y\leqq 0.2$, respectively, as described in U.S. patent application Ser. No. 543,326;

$M^{II}X_2.aM^{II}X'_2:xEu^{2+}$, in which $M^{II}$ is at least one alkaline earth metal selected from the group consisting of Ba, Sr and Ca; each of X and X' is at least one halogen selected from the group consisting of Cl, Br and I, and $X\neq X'$; and a and x are numbers satisfying the conditions of $0.1\leqq a\leqq 10.0$ and $0<x\leqq 0.2$, respectively, as described in U.S. patent application Ser. No. 660,987;

$M^{II}FX.aM^{I}X':xEu^{2+}$, in which $M^{II}$ is at least one alkaline earth metal selected from the group consisting of Ba, Sr and Ca; $M^{I}$ is at least one alkali metal selected from the group consisting of Rb and Cs; X is at least one halogen selected from the group consisting of Cl, Br and I; X' is at least one halogen selected from the group consisting of F, Cl, Br and I; and a and x are numbers satisfying the conditions of $0\leqq a\leqq 4.0$ and $0<x\leqq 0.2$, respectively, as described in U.S. patent application Ser. No. 668,464; and $M^{I}X:xBi$, in which $M^{I}$ is at least one alkali metal selected from the group consisting of Rb and Cs; X is at least one halogen selected from the group consisting of Cl, Br and I; and x is a number satisfying the condition of $0<x\leqq 0.2$, as described in Japanese Patent Application No. 60(1985)-70484.

The $M^{II}X_2.aM^{II}X'_2:xEu^{2+}$ phosphor described in the above-mentioned U.S. patent application Ser. No. 660,987 may contain the following additives in the following amount per 1 mol of $M^{II}X_2.aM^{II}X'_2$:

$bM^{I}X''$, in which $M^{I}$ is at least one alkali metal selected from the group consisting of Rb and Cs; X'' is at least one halogen selected from the group consisting of F, Cl, Br and I; and b is a number satisfying the condition of $0<b\leqq 10.0$, as described in U.S. patent application Ser. No. 699,325;

$bKX''.cMgX'''_2.dM^{III}X''''_3$, in which $M^{III}$ is at least one trivalent metal selected from the group consisting of Sc, Y, La, Gd and Lu; each of X'', X''' and X'''' is at least one halogen selected from the group consisting of F, Cl, Br and I; and b, c and d are numbers satisfying the conditions of $0\leqq b\leqq 2.0$, $0\leqq c\leqq 2.0$, $0\leqq d\leqq 2.0$ and $2\times 10^{-5}\leqq b+c+d$, as described in U.S. patent application Ser. No. 723,819;

yB, in which y is a number satisfying the condition of $2\times 10^{-4}\leqq y\leqq 2\times 10^{-1}$, as described in U.S. patent application Ser. No. 727,974;

bA, in which A is at least one oxide selected from the group consisting of $SiO_2$ and $P_2O_5$; and b is a number satisfying the condition of $10^{-4}\leqq b\leqq 2\times 10^{-1}$, as described in U.S. patent application Ser. No. 727,972;

bSiO, in which b is a number satisfying the condition of $0<b\leqq 3\times 10^{-2}$, as described in U.S. patent application Ser. No. 797,971;

$bSnX''_2$, in which X'' is at least one halogen selected from the group consisting of F, Cl, Br and I; and b is a number satisfying the condition of $0<b\leqq 10^{-3}$, as described in U.S. patent application Ser. No. 797,971;

$bCsX''.cSnX'''_2$, in which each of X'' and X''' is at least one halogen selected from the group consisting of F, Cl, Br and I; and b and c are numbers satisfying the conditions of $0<b\leqq 10.0$ and $10^{-6}\leqq c\leqq 2\times 10^{-2}$, respectively, as described in Japanese Patent Application No. 60(1985)-78033; and $bCsX''.yLn^{3+}$, in which X'' is at least one halogen selected from the group consisting of F, Cl, Br and I; Ln is at least one rare earth element selected from the group consisting of Sc, Y, Ce, Pr, Nd, Sm, Gd, Tb, Dy, Ho, Er, Tm, Yb and Lu; and b and y are numbers satisfying the conditions of $0<b\leqq 10.0$ and $10^{-6}\leqq y\leqq 1.8\times 10^{-1}$, respectively, as described in Japanese Patent Application No. 60(1985)-78035.

Among the above-described stimulable phosphors, the divalent europium activated alkaline earth metal halide phosphor and rare earth element activated rare earth oxyhalide phosphor are particularly preferred, because these show stimulated emission of high luminance. The above-described stimulable phosphors are given by no means to restrict the stimulable phosphor employable in the present invention. Any other phosphors can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate butyrate, polyvinyl alcohol, and linear polyester. Particularly preferred are nitrocellulose, linear polyester, polyalkyl (meth)acrylate, a mixture of nitrocellulose and linear polyester, and a mixture of nitrocellulose and polyalkyl (meth)acrylate. These binders may be crosslinked with a crosslinking agent.

The phosphor layer can be formed on the support, for instance, by the following procedure.

In the first place, stimulable phosphor particles and a binder are added to an appropriate solvent, and then they are mixed to prepare a coating dispersion comprising the phosphor particles homogeneously dispersed in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the stimulable phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:40.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly onto the surface of the support to form a layer of the coating dispersion. The coating procedure can be carried out by a conventional method such as a method using a doctor blade, a roll coater or a knife coater.

After applying the coating dispersion onto the support, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within the range of from 20 μm to 1 mm, and preferably from 50 to 500 μm.

The phosphor layer can be provided onto the support by the methods other than that given in the above. For instance, the phosphor layer is initially prepared on a sheet (false support) such as a glass plate, metal plate or plastic sheet using the aforementioned coating dispersion and then thus prepared phosphor layer is superposed on the genuine support by pressing or using an adhesive agent.

On the surface of the phosphor layer is provided a protective film. The protective film which is a characteristic requisite of the present invention is a transparent thin film made from polyethylene terephthalate.

The protective film can be provided onto the phosphor layer, for instance, by beforehand preparing a transparent polyethylene terephthalate film, followed by placing and fixing it onto the phosphor layer with an appropriate adhesive agent.

It is required that the longitudinal strength and the lateral strength of the protective film are equal to each other or that the difference therebetween is within 10% of the larger strength. Preferably, the longitudinal strength and the lateral strength are equal to each other or the difference therebetween is within 5% of the larger strength.

The total of the longitudinal strength and the lateral strength of the protective film is preferably not less than 25 kg/mm$^2$, and more preferably not less than 28 kg/mm$^2$, when the strength is defined by a force (N-5) required to stretch by 5% longer than its initial length. The protective film preferably has a thickness within the range of approximately 3 to 20 μm.

The radiation image storage panel of the invention may be colored with a colorant to enhance the sharpness of the resulting image as described in U.S. Pat. No. 4,394,581 and U.S. patent application Ser. No. 326,642. For the same purpose, the phosphor layer of the radiation image storage panel may contain a white powder as described in U.S. Pat. No. 4,350,893.

The following examples further illustrate the present invention, but these examples are by no means understood to restrict the invention.

EXAMPLES 1-2

To a mixture of a particulate divalent europium activated barium fluorobromide (BaFBr:Eu$^{2+}$) phosphor and a linear polyester resin were added successively methyl ethyl ketone and nitrocellulose (nitration degree: 11.5%), to prepare a dispersion containing the phosphor particles. Subsequently, tricresyl phosphate, n-butanol and methyl ethyl ketone were added to the dispersion. The mixture was sufficiently stirred by means of a propeller agitator to obtain a homogeneous coating dispersion having a mixing ratio of 1:20 (binder:phosphor, by weight) and a viscosity of 25-35 PS (at 25° C.).

The coating dispersion was applied evenly onto a polyethylene terephthalate sheet (support, thickness: 250 μm) placed horizontally on a glass plate. The application of the coating dispersion was carried out using a doctor blade. After the coating was complete, the support having a layer of the coating dispersion was placed in an oven and heated at a temperature gradually rising from 25° to 100° C. Thus, a phosphor layer having a thickness of approx. 300 μm was formed on the support.

On the phosphor layer was placed a transparent polyethylene terephthalate film (thickness: 10 μm; provided with a polyester adhesive layer on one surface) having a strength set forth in Table 1 to combine the transparent film and the phosphor layer with the adhesive layer.

Thus, two kinds of radiation image storage panels consisting essentially of a support, a phosphor layer and a protective film were prepared.

COMPARISON EXAMPLES 1-7

The procedure of Example 1 or 2 was repeated except for using various transparent polyethylene terephthalate films (thickness: 10 μm; provided with a polyester adhesive layer on one surface) having a strength set forth in Table 1 as a material of the protective film, to prepare various radiation image storage panels consisting essentially of a support, a phosphor layer and a transparent protective film.

The polyethylene terephthalate films employed in Comparison Examples 1 and 5 are generally employed as a material of the protective film of the conventional radiation image storage panel.

The strength of the polyethylene terephthalate films employed for the protective films in Examples 1 and 2, and Comparison Examples 1 to 7 are set forth in Table 1. In Table 1, the strength is defined by a force (F-5) required to stretch the film by 5% longer than the initial length of the film, and the difference between the longitudinal strength and the lateral strength is expressed by a ratio to the longitudinal strength.

TABLE 1

| | Strength (kg/mm$^2$) | | Difference of Strength |
|---|---|---|---|
| | Longitudinal | Lateral | (%) |
| Example 1 | 14.7 | 14.6 | 0.7 |
| Example 2 | 15.2 | 14.0 | 8.6 |
| Com. Example 1 | 15.8 | 10.2 | 35.4 |
| Com. Example 2 | 17.2 | 10.9 | 36.7 |
| Com. Example 3 | 18.7 | 9.6 | 48.7 |
| Com. Example 4 | 18.9 | 10.5 | 44.4 |
| Com. Example 5 | 12.5 | 11.1 | 11.2 |
| Com. Example 6 | 11.5 | 10.2 | 11.3 |
| Com. Example 7 | 11.6 | 10.3 | 11.2 |

EVALUATION

The above-described radiation image storage panels were evaluated on the transfer properties according to the following test.

The radiation image storage panel was cut to give a test strip (100 mm×250 mm), and the test strip was moved in a transfer testing device shown in FIG. 1. The test strip was introduced into the device from an inlet (arrow 1) and moved through guide plates 2 and nip rolls 3 (diameter: 25 mm). Subsequently, the test strip was bent inside along a robber roll 5 by means of a transfer belt 4, and then outside along a rubber rolls 5' (diameter: 40 mm) by means of a transfer belt 4', and further moved through guide sheets and nip rolls. After this transfer operation was repeated, occurrence of damages (cracks) on the protective film of the test strip was observed by eyes.

The results are set forth in Table 2.

TABLE 2

| | Occurrence of Crack | |
|---|---|---|
| | Longitudinal Direction | Lateral Direction |
| Example 1 | not observed (3000 round-trip) | not observed (3000 round-trip) |
| Example 2 | not observed (3000 round-trip) | not observed (3000 round-trip) |
| Com. Example 1 | not observed (3000 round-trip) | observed (800 round-trip) |
| Com. Example 2 | not observed (3000 round-trip) | observed (1000 round-trip) |
| Com. Example 3 | not observed (3000 round-trip) | observed (600 round-trip) |

TABLE 2-continued

| | Occurrence of Crack | |
|---|---|---|
| | Longitudinal Direction | Lateral Direction |
| Comp. Example 4 | not observed (3000 round-trip) | observed (1000 round-trip) |
| Com. Example 5 | observed (2500 round-trip) | observed (2000 round-trip) |
| Com. Example 6 | observed (1200 round-trip) | observed (700 round-trip) |
| Com. Example 7 | observed (1400 round-trip) | observed (1000 round-trip) |

As is evident from the results set forth in Table 2, the radiation image storage panels according to the invention (Examples 1 and 2) caused no crack on the protective film when the panels were moved in either of the longitudinal and lateral directions. On the other hand, all of the radiation image storage panels for comparison (Examples 1 to 7, wherein those of Examples 1 and 5 are conventional ones) caused cracks when the panels were moved in one or both of the longitudinal and lateral direction, and it was confirmed that the panels for comparison were unable to endure the transfer in both the longitudinal and lateral directions.

We claim:

1. A radiation image storage panel comprising a support, a phosphor layer which comprises a binder and a stimulable phosphor dispersed therein and a protective film, superposed in this order, characterized in that said protective film comprises polyethylene terephthalate, and has the longitudinal strength and the lateral strength equal to each other or in a difference therebetween of not more than 10%, the value being determined based on the larger strength, in which said protective film has the longitudinal strength and the lateral strength in a total of not less than 25 kg/mm$^2$.

2. The radiation image storage panel as claimed in claim 1, in which said protective film has the longitudinal strength and the lateral strength equal to each other or in a difference therebetween of not more than 5%.

3. The radiation image storage panel as claimed in claim 1, in which said protective film has a thickness within the range of 3–20 $\mu$m.

* * * * *